US008371513B2

(12) United States Patent
Neumann

(10) Patent No.: US 8,371,513 B2
(45) Date of Patent: Feb. 12, 2013

(54) TRACK COVERING

(75) Inventor: Bernhard Neumann, Gmunden (AT)

(73) Assignee: Gmundner Fertigteile Gesellschaft m.b.H. & Co. KG., Gmunden (AT)

( * ) Notice: Subject to any disclaimer, the term of this patent is extended or adjusted under 35 U.S.C. 154(b) by 257 days.

(21) Appl. No.: 12/678,115

(22) PCT Filed: Oct. 8, 2008

(86) PCT No.: PCT/AT2008/000363

§ 371 (c)(1),
(2), (4) Date: Mar. 12, 2010

(87) PCT Pub. No.: WO2009/049338

PCT Pub. Date: Apr. 23, 2009

(65) Prior Publication Data

US 2011/0215164 A1 Sep. 8, 2011

(30) Foreign Application Priority Data

Oct. 17, 2007 (AT) ..... GM 637/2007

(51) Int. Cl.
*E01B 1/00* (2006.01)
*E01C 9/00* (2006.01)

(52) U.S. Cl. ..... 238/6

(58) Field of Classification Search ..... 238/2–9
See application file for complete search history.

(56) References Cited

U.S. PATENT DOCUMENTS 3,643,864 A 2/1972 Ziegler
6,129,288 A 10/2000 Petersen et al.
6,431,462 B1 * 8/2002 Apostolou et al. ..... 238/8

FOREIGN PATENT DOCUMENTS

WO 02/090658 A2 11/2002
WO 02/090659 A1 11/2002
WO WO02/090659 * 11/2002

OTHER PUBLICATIONS

International Search Report PCT/AT2008/000363, Dec. 10, 2008.
Office Action Mailed Jul. 30, 2008 in Austria Application No. 637/2007.
English translation of Written Opinion dated May 20, 2010, as issued in International Application No. PCT/AT2008/000363.

* cited by examiner

*Primary Examiner* — Robert McCarry, Jr.
(74) *Attorney, Agent, or Firm* — Sughrue Mion, PLLC

(57) ABSTRACT

A track cover comprising slab-shaped cover elements (7) arranged between the rails (3) of the track (2) on rail level and, preferably, also slab-shaped cover elements (8) outwardly adjoining the rails (3). The cover elements (7, 8) comprise supporting bodies (9) at their rims (10) which face the rails (3), the cover elements resting on the rails (3) by means of these supporting bodies. The supporting bodies (9) which are arranged on the cover elements (7, 8) at their rims (10) that face the rails (3) are mounted on these cover elements so as to be shiftable in the rail-longitudinal direction (11). It is suitable if on each rim (10) of the cover elements (7, 8) that faces a rail (3) which is provided with the cover, at least two supporting bodies (9) are shiftably arranged. Preferably, the supporting bodies (9) are mounted to be shiftable in the rail-longitudinal direction (11) and to be pivotable about a geometric axis extending in parallel with the displacement direction.

34 Claims, 12 Drawing Sheets

TRACK COVERING

CROSS REFERENCE TO RELATED APPLICATIONS

This application is a National Stage of International Application No. PCT/AT2008/000363 filed Oct. 8, 2008, claiming priority based on Austrian Patent Application No. GM 637/2007, filed Oct. 17, 2007, the contents of all of which are incorporated herein by reference in their entirety.

The invention relates to a track cover comprising slab-shaped cover elements arranged between the rails of the track on rail level and, preferably, also slab-shaped cover elements outwardly adjoining the rails, wherein the cover elements comprise supporting bodies at their rims which face the rails, the cover elements resting on the rails by means of these supporting bodies.

In the construction of tracks, sleepers are arranged wherever possible, with an equal mutual spacing. Often, however, it is not possible to maintain equal mutual spacings of the sleepers during the construction of tracks, such as in the region of shunts, railroad crossings or also in the region of curved tracks. Yet, if the mutual spacings of the sleepers in the region of a track, at which a track cover is to be installed, are not equal, difficulties often occur in known track covers of the aforementioned type, in which the cover elements have supporting bodies moulded to their rims which face the rails, since the location of the rail fastening elements which is determined by the position of the sleepers does not correspond with the location of the recesses provided between successive supporting bodies to allow that the supporting bodies can rest on the rails of the track without being impeded by the rail fastening elements.

It is an object of the present invention to provide a track cover of the initially defined type in which even if sleepers with uneven mutual spacing are provided at the site of a track cover to be constructed, an impediment to the support of the supporting bodies—of the cover elements—on the rails caused by the rail fastening elements present there can be avoided.

The inventive track cover of the initially defined type is characterized in that the supporting bodies arranged on the cover elements at those rims thereof that face the rails are mounted on these cover elements so as to be shiftable in the rail-longitudinal direction. By this design, the previously indicated object can well be met. The slab-shaped cover elements provided in the track cover designed according to the invention can be realized by a simple construction and by the realized shiftable mounting of the supporting bodies on the cover elements, these supporting bodies can be displaced for the installation of the cover elements so as to form the track cover such that also with irregularly spaced sleepers, a coincidence of the supporting bodies with the rail fastening elements that are arranged on the sleepers will be avoided. In combination with the shiftable mounting of the supporting bodies in the rail-longitudinal direction, for achieving a stable fit of the cover elements it is suitable if it is provided for at least two supporting bodies to be shiftably arranged on each cover element rim that faces a rail of the track provided with the cover.

For the procedure of inserting the cover elements in the position provided in the finished track cover, in which the cover elements rest on the rails by means of their supporting bodies, and also for a possible removal of the cover elements it is advantageous and preferred within the scope of the present invention if it is provided for the supporting bodies to be mounted so as to be shiftable in rail-longitudinal direction and pivotable about a geometric axis in parallel to the displacement direction, wherein the supporting bodies, starting out from a supporting position in which they extend, substantially following the area of the respective cover element, from this cover element to the adjacent rail, are downwardly tiltable due to this pivotability.

Here, a solution which is advantageous in terms of construction results if it is provided for the supporting bodies to be shiftably mounted on tilting bodies which in turn are pivotably mounted on the cover elements. In this case, it is simple and suitable in terms of construction if it is provided that for the shiftable mounting of the supporting bodies on the respective associated tilting body, these tilting bodies on the one hand and the supporting bodies on the other hand are provided with shaped-in grooves and moulded-on ledges engaging in these grooves.

A structurally very simple realization of a track cover designed according to the invention in which the supporting bodies are shiftably mounted on the cover elements also results if it is provided that for the shiftable mounting of the supporting bodies on the cover elements, grooves are shaped in and ledges engaging in these grooves are moulded onto these cover elements on the one hand and on the supporting bodies on the other hand. Such a design also allows for a high amount of load-bearing capacity and stability to be achieved by way of a simple construction.

For carrying out the manipulations required for the insertion of the cover elements in their position that corresponds to the track cover, and for any possible removal of the cover elements, an embodiment of the track cover according to the invention is advantageous which is characterized in that the cover elements are configured as pairs of slabs, wherein the two slabs of the respective pair are assembled in hinge-type manner, the geometric axis of the hinge-like assembly extending in parallel with the rail-longitudinal direction. Thus, the supporting bodies can be shiftably mounted on the two slabs of the respective pair of the slab pairs which form the cover elements, wherein, in addition thereto, by the hinge-like assembly of the two slabs of the respective pair of slabs during the installation and during any possible removal of the cover elements, a pivoting movement of the supporting bodies which will facilitate these procedures can occur by the hinge-like assembly of the two slabs of the respective pair.

With a view to the structural design of the shiftable mounting of the supporting bodies on the cover elements it is advantageous if it is provided that for the shiftable mounting of the supporting bodies on the cover elements, at their side which faces the supporting bodies, a slit channel is provided, the slit of which faces the supporting bodies, and a carrying ledge projecting through this slit into the interior of the channel is provided on the supporting bodies, which carrying ledge has an enlargement in that zone which is present in the channel, which enlargement is larger than the width of the slit.

A variant thereto is characterized in that for the shiftable mounting of the supporting bodies on the cover elements, at that side of the supporting bodies which faces the cover elements, a slit channel is provided, the slit of which faces the associated cover element, and in that a carrying ledge projecting through this slit of the channel is provided on this cover element, which carrying ledge has an enlargement at that zone which is present in the channel, which enlargement is larger than the width of the slit.

These designs may advantageously be further developed by providing for the carrying ledge to be pivotably movable within the slit channel.

In this way, pivotability of the supporting bodies is achieved in a simple manner in addition to their shiftability. A solution of simple construction which is also functionally suitable can be obtained if it is provided for the slit channel to have a polygonal cross-section and for the carrying ledge projecting into this channel to have a T-cross-section, wherein the cross-beam of the T-cross-section of the carrying ledge with one edge thereof faces a corner of the channel cross-section, and with the other edge facing a side located opposite this corner of the channel cross-section, the carrying ledge thus being pivotably movable about its edge that faces a corner of the channel cross-section.

A variant thereto is characterized in that the slit channel has a circular cross-section and the carrying ledge that projects through the slit into the channel in the form of a web, at its zone inserted in the respective channel has a cross-sectional shape fittingly abutting the channel surface.

The carrying ledges provided in the embodiments of the inventive track cover which have a slit channel for mounting the supporting elements on the cover elements may be independent ledge-like bodies which are assembled with the supporting bodies or with the cover elements, wherein, e.g., one possible way of realizing a carrying ledge with a section ledge provides for a section ledge of T-shaped cross-section, a part of the middle leg of the section ledge being embedded in the respective supporting body or in the rim zone of a cover element. For realizing the carrying ledges, also other single-piece section ledges with a cross-section different from the T-shape may be used, and the carrying ledges may also be assembled of several parts, wherein such an assembled carrying ledge may have a uniform cross-section throughout its longitudinal extension or may be differently constructed at various locations of its longitudinal extension; thus, an advantageous embodiment of such a carrying ledge may be formed by providing a holding ledge that is entirely shiftable in the slit channel and by connecting this holding ledge with webs extending transversely to its longitudinal extension, which webs project through the slit of the channel and are connected to elements that form an anchoring on the supporting body or cover element associated to the carrying ledge.

Another suitable embodiment is characterized in that the carrying ledge forms an integrally co-moulded part of the respective supporting body.

This solution is particularly simple if the respective supporting body is made of a particularly strong material, e.g. metal. If the supporting bodies are made of a material of less strength, such as, e.g., a composite material formed of small-sized particles and a binder, or of an elastomer material, it is advantageous that the supporting bodies are provided with a reinforcement which extends as far as into the zone of the carrying ledge present within the channel of the respective cover element.

In this case, an advantageous design results if it is provided for the reinforcement to be formed by an assemblage of lamellas whose shape follows the cross-sectional shape of the supporting bodies with the carrying ledges at a distance therefrom, these lamellas being mutually spaced apart and consecutively arranged in the longitudinal direction of the supporting bodies.

A further embodiment of an inventive track cover wherein, for the shiftable mounting of the supporting bodies on the cover elements, these supporting bodies have a slit channel, in which a carrying ledge provided on the respective cover element engages, is characterized in that the carrying ledge forms an integrally co moulded part of the respective cover element. In many cases it is suitable if it is provided for the respective cover element to have a reinforcement which extends as far as into that zone of the carrying ledge that is present within the slit channel of the respective supporting body. In this context it is furthermore advantageous if it is provided for the reinforcement to be formed by an assemblage of lamellas, whose shape, in the region of the carrying ledge, follows the cross-sectional shape of the carrying ledge at a distance therefrom, these lamellas being mutually spaced apart and consecutively arranged in the longitudinal direction of the carrying ledge.

A slit channel, as it is provided in a number of embodiments of the present invention for the shiftable mounting of the supporting bodies and, preferably, in addition thereto, a pivotable mounting of these supporting bodies, is preferably formed by embedding a slit pipe, whose cross-sectional shape corresponds to the cross-sectional shape provided for the channel. In this way, the production of such channels can be carried out in a simple manner, wherein a good precision of the cross-sectional dimensions of such channels can be achieved without any problems and a smooth inner side of these channels can be achieved which allows for a smooth-running movability of the supporting bodies with regard to the cover elements, on which these supporting bodies are provided. Such slit pipes provided for forming slit channels may also serve to mechanically reinforce cover elements and may also form reinforcing bodies in combination with other reinforcements serving for a mechanical strengthening of the cover elements and to be embedded in such cover elements. In this regard, an embodiment of the inventive track cover is advantageous which is characterized in that slit pipes which are arranged in cover elements and provided for engagement with carrying ledges that are seated on supporting bodies, are each connected to several rods that extend transversely to the rail-longitudinal direction in these cover elements, which rods, viewed in the rail-longitudinal direction, are spaced apart and consecutively arranged, these slit pipes together with these rods forming a reinforcing body.

An advantageous further development of this concept is characterized in that two reinforcing bodies are embedded in cover elements, each reinforcing body being formed of a slit pipe and of rods which extend transversely to said pipe and which are connected to this pipe, said slit pipes being arranged on those rims of the cover elements which extend in parallel with the rails, and the rods of the one reinforcing body are located in the spaces between the rods of the other reinforcing body.

For obtaining as effective a mechanical reinforcement of the cover elements as possible, it is furthermore advantageous if it is provided for the rods of the one reinforcing body to extend as far as to the slit pipe of the other reinforcing body and, likewise, for the rods of the other reinforcing body to extend as far as to the slit pipe of the one reinforcing body.

For the sake of obtaining a good reinforcing effect with comparatively little expenditures while avoiding problems resulting from electric induction, which may, e.g., affect devices reporting that a track is clear, it is advantageous if it is provided for the slit pipes and the rods of the reinforcing bodies to be made of metal and for the slit pipes to be electrically insulated from the rods of the respective other reinforcing body at the contacting sites with said rods.

For the sake of manipulating without any problems the cover elements when joining the latter to the rails of the track and when possibly removing these cover elements, it is suitable to provide fixing means for fixing the shiftably mounted supporting bodies in the respectively provided position. If for the shiftable mounting of the supporting bodies on the cover elements, one slit channel and one carrying ledge projecting into the interior of this channel are each provided, a suitable solution will result if it is provided that for fixing the shiftably mounted supporting bodies in their respectively provided position, clamping bodies are inserted in the respective slit channel, which clamping bodies can be pressed at the channel surface. In this case, it is furthermore advantageous if screws are provided for pressing the clamping body at the channel surface.

To facilitate the joining of the supporting bodies to the rails of the track that is to be provided with a track cover, which joining mostly is carried out with elastomer sections interposed, it is advantageous if it is provided that on the lower side of the supporting bodies a flexible guiding lip projecting towards the neighbouring rail is provided. Such a guiding lip may help avoid work-disturbing jammings and will guide the supporting bodies into the lateral recesses of the rails in a simple manner, in which recess, as has been mentioned before, elastomer sections may already be arranged, which elastomer sections, in the finished track cover, will be arranged between the respective rail and the supporting bodies resting on these rails.

The invention will now be explained in more detail by way of exemplary embodiments and with reference to the drawings in which such exemplary embodiments are schematically illustrated.

In the drawings,

FIG. 1 shows an exemplary embodiment of a track cover designed according to the invention seen in top view, and FIG. 2 shows a part of this track cover on an enlarged scale in a section according to line II-II. In an illustration analogous to FIG. 2, FIG. 3 shows a situation prevailing in the exemplary embodiment according to FIGS. 1 and 2 before the cover elements are inserted in the track. In a sectional illustration analogous to FIG. 2, FIG. 4 shows an exemplary embodiment modified compared to the example according to FIGS. 1 and 2, wherein the cover elements have been inserted in the track, and FIG. 5 shows this example in a state before the cover elements have been inserted in the track. A further example in which the supporting bodies are shiftably and pivotably mounted on the cover elements is shown in section in FIGS. 6 and 7, and in analogy to FIGS. 2 and 3, FIG. 6 shows the finished state of the track cover, and FIG. 7 shows the state prevailing just before the cover elements are inserted in the track. A variant in which the supporting bodies are shiftably and pivotably mounted is shown in FIG. 8 in a section analogous to that of FIG. 2.

Figure 1:
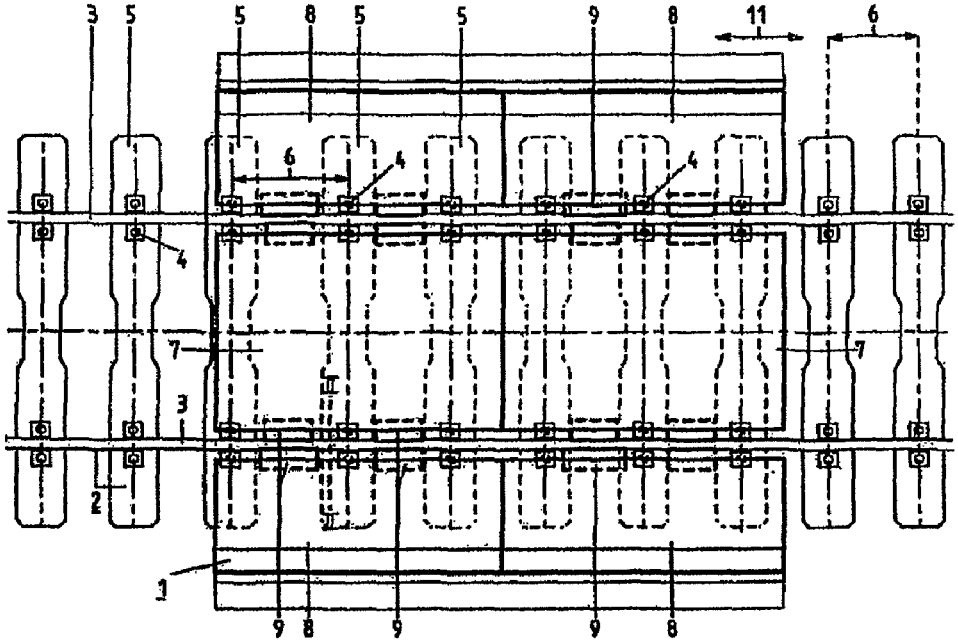
Figure 2:
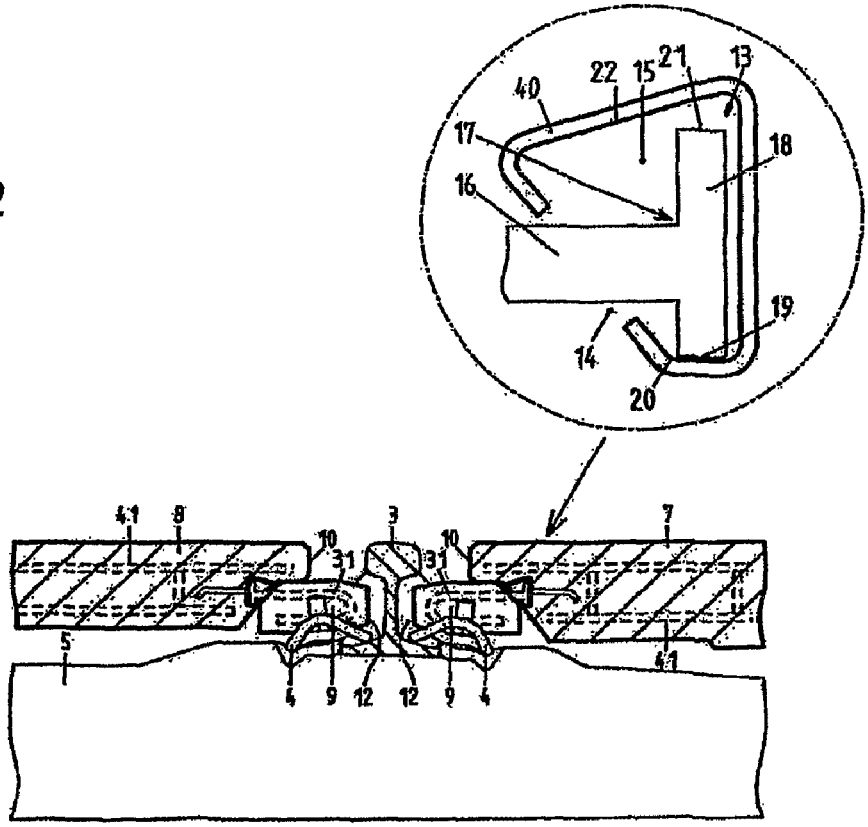
Figure 3:
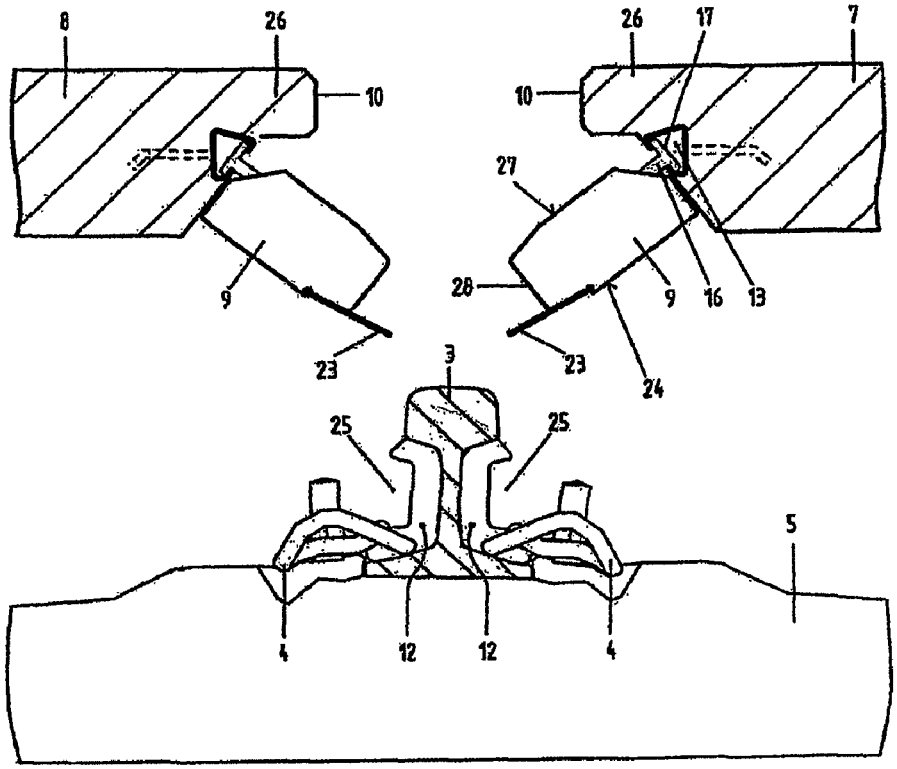

The exemplary embodiment of a cover element 1 illustrated in FIGS. 1-3 is provided on a track 2 whose rails 3 are fixed on sleepers 5 by rail fastening means 4. The mutual spacings 6 between the sleepers 5 vary among themselves. The track cover 1 is formed by slab-shaped cover elements 7 arranged between the rails 3 and by slab-shaped cover elements 8 arranged to outwardly adjoin the rails. At their rims 10 which face the rails, the cover elements 7, 8 comprise supporting bodies 9 by means of which the cover elements 7, 8 rest on the rails 3 with elastic sections 12 being interposed.

The supporting bodies 9 are mounted on the cover elements 7, 8 so as to be shiftable in rail-longitudinal direction 11, and by appropriate displacement can thus be positioned at their respective site of installation such that they will come to rest on the rails 3 without being adversely affected by rail fastening elements 4 even if different sleeper spacings 6 exist. For this shiftable mounting of the supporting bodies 9, a slit channel 13 is provided on the respective cover element 7, 8 at its side facing the supporting bodies, the slit 14 of which faces the supporting bodies 9, and a carrying ledge 16 projecting through this slit 14 into the interior 15 of the channel 13 is provided on the supporting bodies 9, which carrying ledge 16 has an enlargement 17 at that zone which is present in the channel, which enlargement 17 is larger than the width of the slit 14. In this way, a longitudinally shiftable mounting of the supporting body on the respective cover element 7, 8 is formed by the longitudinal shiftability of the carrying ledge 16 within the channel 13.

The slit channel 13 provided in the cover elements 7, 8 has a polygonal cross-section, wherein one corner 20 of this cross-section is at the bottom, and the carrying ledge 16 provided at the individual supporting bodies 9 and projecting into the channel 13 has a T-cross-section, wherein the cross-beam 18 of the T-cross-section has an edge 19 that faces the aforementioned lower corner 20 of the cross-section of the channel 13. The other edge 21 of the T-cross-section faces the side 22 of the cross-section of the channel 13 located opposite the corner 20 thereof, whereby, due to the width of this side 22, the transverse beam 18 of the T-cross-section of the carrying ledge 16 projecting into the channel 13 and, thus, the carrying ledge 16 and the respective supporting body 9 connected to this carrying ledge, is pivotably movable about the edge 19. By this pivotably movable mounting of the supporting bodies 9, these supporting bodies can be tilted downwards as shown by FIG. 3, starting out from a supporting position illustrated in FIG. 2, in which these supporting bodies extend so as to substantially follow the area over which the respective cover element extends from this cover element to the adjacent rail 3. This pivotability of the supporting bodies 9 facilitates the installation of the cover elements into the respective existing track and also facilitates a possible removal of the cover elements. Installation of the cover elements into a track may be further facilitated by providing a flexible guiding lip 23 arranged on the lower side 24 of the supporting body 9 so as to project towards the respective adjacent rail 3. When lowering the cover elements from the position illustrated in FIG. 3, this flexible guiding lip 23 will lay down into the lateral recess 25 of the respective elastic section 12, thereby guiding the supporting body 9 into this recess 25 so as to support the respective supporting body 9, and the respective cover element on which this supporting body is arranged, respectively, relative to the rail 3. In the course of this movement, the supporting bodies 9 arrive in their supporting position illustrated in FIG. 2, in which they abut on their associated cover elements, wherein the cover elements—by means of a carrying rib 26 moulded thereto—abut on the upper side 27 of the supporting bodies 9. During the insertion of the cover elements into the track, when the supporting bodies come to engage in the lateral recess 25 of the sections 12, the flexible guiding lip 23 will come to lie at the front side 28 of the supporting bodies 9.

Figure 4:
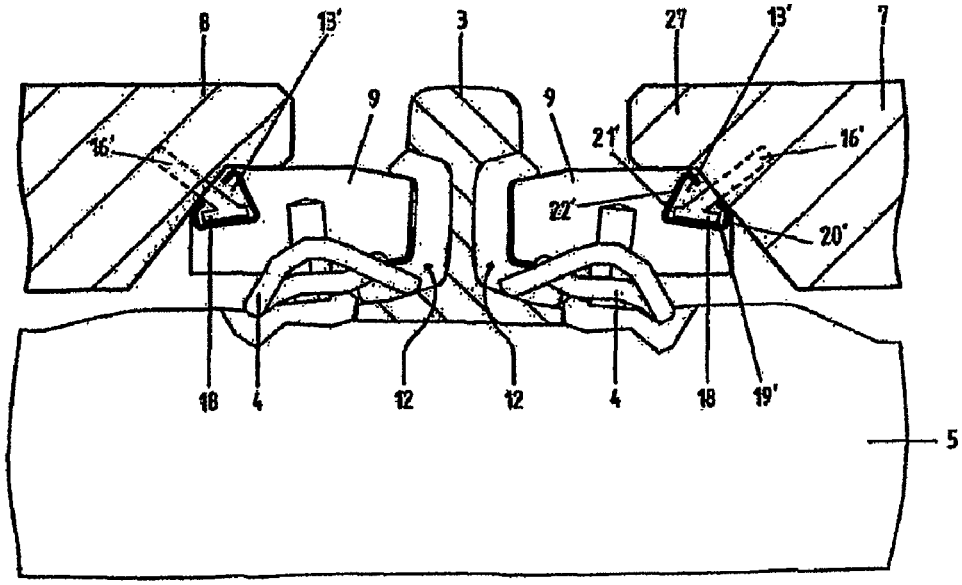
Figure 5:
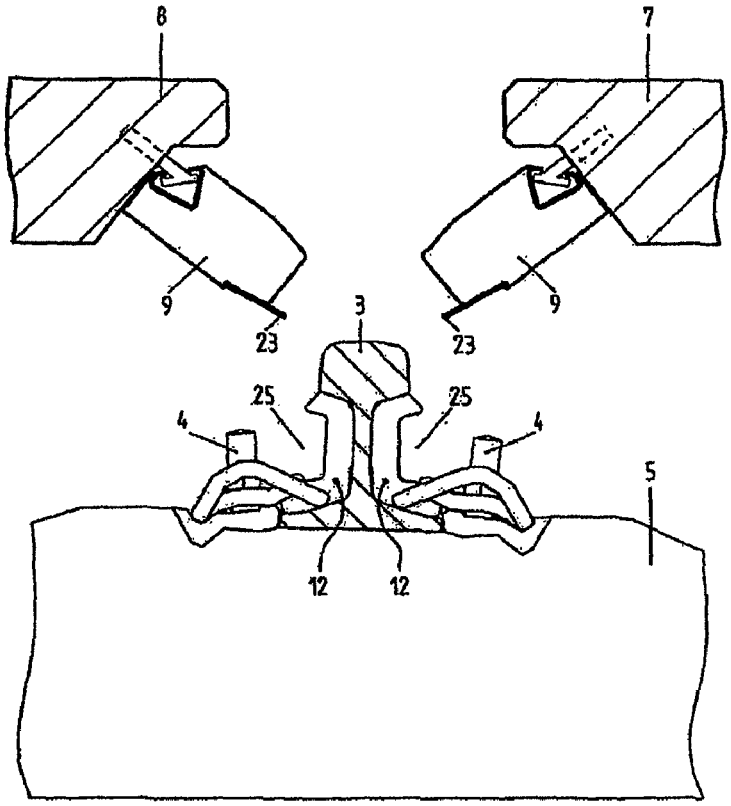

In the exemplary embodiment illustrated in FIGS. 4 and 5, the mounting of the supporting bodies 9 on the cover elements 7, 8 has been modified compared to that of the exemplary embodiment according to FIGS. 1-3, wherein also in this modified exemplary embodiment the supporting bodies are shiftable on the cover elements in the rail-longitudinal direction and mounted to be pivotable about a geometric axis in parallel to the displacement direction, and downwardly tiltable by this pivotability. In this exemplary embodiment, on the side of the supporting body 9 which faces the cover elements 7, 8, a slit channel 13' is provided, whose slit 14' faces the associated cover element, and on the respective cover element 7, 8, a carrying ledge 16' is provided which projects through the slit 14' of the channel and which has an enlargement 17' at its zone present in the channel 13', which enlargement is larger than the width of the slit 14'. The carrying ledge 16' has a T-cross-section, wherein the transverse beam 18 of the T-cross-section of the carrying ledge 16' forms the aforementioned enlargement, and by means of an edge 19' faces the lower corner 20' of the channel cross-section and, by means of the other edge 21', faces towards a side 22' of the polygonal channel cross-section located opposite the lower corner 20'. The supporting bodies 9 thus are mounted to be pivotably movable about the edge 19' of the carrying ledge 16' that faces the lower corner 20' of the channel cross-section, and simultaneously shiftably mounted on the cover elements in the rail-longitudinal direction due to the fact that the carrying ledge 16' is longitudinally shiftable within the channel 13'. Due to this pivotability provided in the mounting of the supporting bodies 9 on the cover elements 7, 8, the supporting bodies 9 are capable of being tilted downwards, as illustrated in FIG. 5, from the supporting position illustrated in FIG. 4, in which the supporting bodies rest abut on the cover elements and are in contact with the carrying rib 26 provided on the cover elements. This FIG. 5 position is assumed by the cover elements and by the supporting bodies provided thereon just before the cover elements are inserted in a track.

Figure 6:
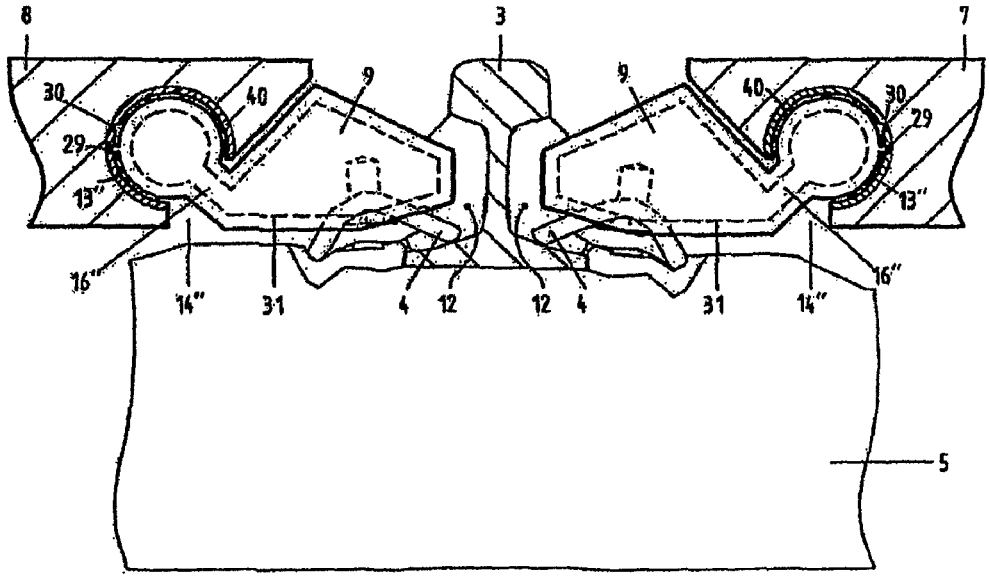
Figure 7:
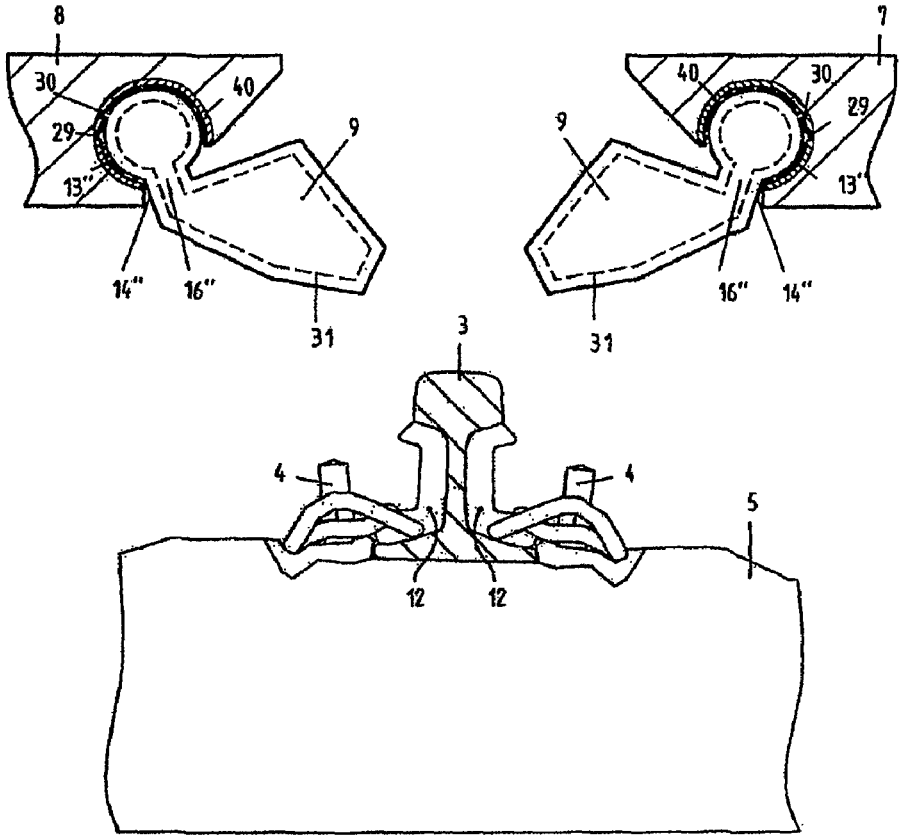

Also in the exemplary embodiment illustrated in FIGS. 6 and 7, which, seen in top view, is analogous to the representation of FIG. 1, mounting of the supporting bodies 9 on the cover elements 7, 8 is shiftable in the rail-longitudinal direction and, at the same time, pivotable. In this instance, a slit channel 13" is provided in the cover elements on their side which faces the supporting bodies 9, which channel 13" has a circular cross-section, and a carrying ledge 16" is provided on the supporting bodies 9, which carrying ledge projects through the slit 14" into the channel 13" and, at its zone inserted in the channel, has a cross-sectional shape fittingly abutting the channel surface. In the case illustrated, this zone of the carrying ledge inserted in the channel has a circular cross-section fitting into the channel; yet, a polygonal or star-shaped or similar cross-section of this carrying ledge 16" which fits into the circular cross-section of the channel 13", may just as well be provided. A snap-in projection 29 provided on the carrying ledge 16", and snap-in recesses 30 matching this snap-in projection and provided on the wall of the slit channel 13", serve to position the pivoted position of the supporting bodies 9 in the supported position shown in FIG. 6, on the one hand, and in the downwardly tilted position of the supporting bodies illustrated in FIG. 7, on the other hand. In the exemplary embodiment illustrated in FIGS. 6 and 7, the carrying ledge 16" constitutes an integrally co-moulded part of the respective supporting body 9. Such a design offers particular advantages in terms of construction particularly if supporting bodies are provided which are made of a high-strength material, e.g. metal. Yet, also in such a case where the supporting bodies are integrally made in one piece with their respective associated carrying ledge so as to form the supporting bodies, materials of somewhat lower strength can be used, e.g. composite materials of small-sized particles and binder or elastomers, wherein, particularly in such a case, the supporting bodies will be provided with a reinforcement 31 which extends as far as into the zone of the carrying ledge 16" that is located in the channel 13" of the respective cover element 7, 8, as indicated in dashed lines in FIGS. 6 and 7. Such a reinforcement 31 may advantageously be formed by an assemblage of lamellas, whose shape follows the cross-sectional shape of the supporting bodies 9 with the carrying ledges 16" at a distance therefrom, these lamellas being—mutually spaced apart—consecutively arranged in the longitudinal direction of the supporting bodies 9.

Figure 8:
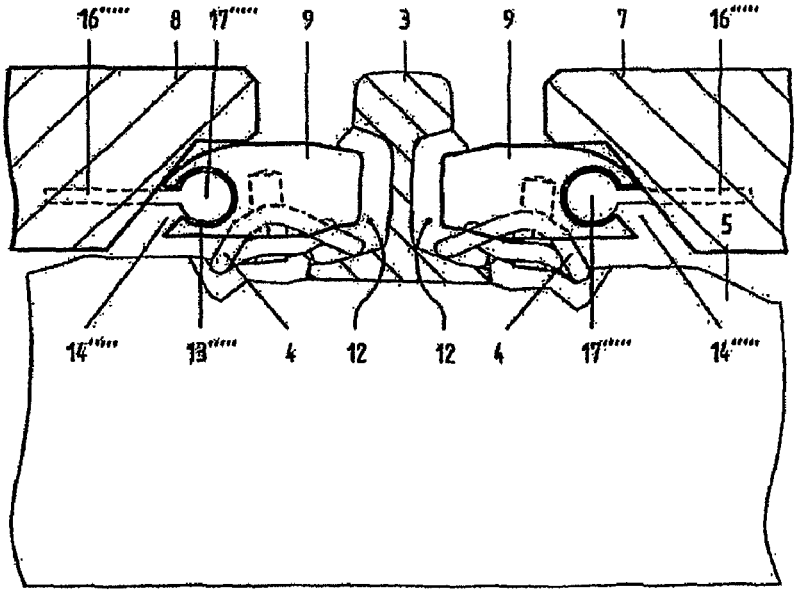

In the exemplary embodiment illustrated in FIG. 8, for mounting the supporting bodies 9 on the cover elements 7, 8 so as to be shiftable in the rail-longitudinal direction and pivotable about a geometric axis in parallel to the displacement direction, in analogy to the exemplary embodiment according to FIGS. 4 and 5, a slit channel 13"" is provided in each supporting body, a carrying ledge 16"" provided on the respective cover element 7, 8 extending into said channel through the slit 14"". The channel 13 has a circular cross-section, and also the enlargement 17"" of the carrying ledge 16 inserted in this channel has a circular cross-section matching this channel; yet, this portion of the carrying ledge may just as well have a polygonal or star-shaped or similar cross-section which fits into the circular cross-section of this channel.

Figure 9:
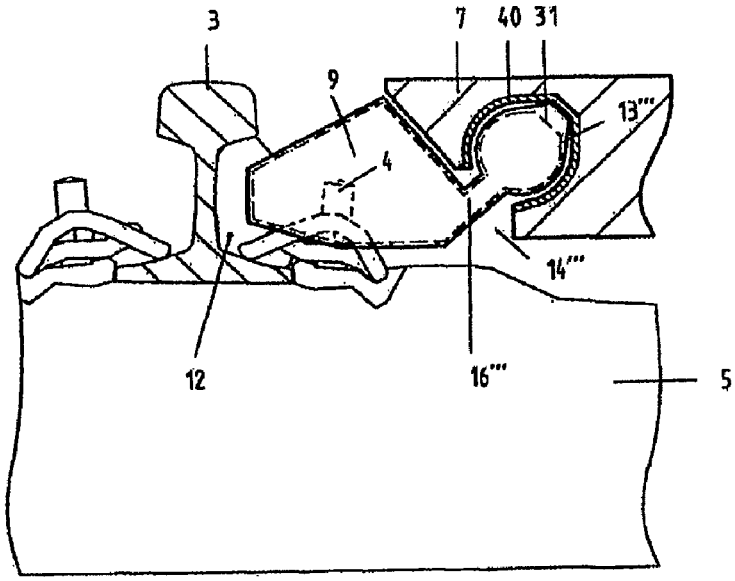
FIGS. 9 and 10 show two exemplary embodiments each in a section analogous to FIG. 2, wherein the supporting bodies are merely shiftably mounted on the cover elements. In a sectional illustration analogous to FIG. 2.

FIG. 9 shows in a sectional representation analogous to FIG. 6 an exemplary embodiment which is to be considered to be a variant to FIG. 6. Also in this exemplary embodiment according to FIG. 9, a slit channel 13''' is provided in the cover elements 7, 8, into which a carrying ledge 16''' projects through the slit 14''', the carrying ledge 16''' being longitudinally shiftably mounted in the channel 13''' and having a zone present in the channel of the respective cover element, which zone has a shape corresponding to the channel cross-section. This carrying ledge is an integrally co-moulded part of the respective supporting body 9, and a reinforcement 31 is provided in the supporting bodies, which reinforcement extends as far as into the zone of the carrying ledge 16''' present in the channel 13''' of the respective cover element. Preferably, also in this case, the reinforcement is constituted by an assemblage of lamellas. In this embodiment according to FIG. 9, the cross-section of the channel 13''' and, in conformity therewith, the zone of the carrying ledge 16''' present in the channel are shaped to be out-of-round and, thus, there is no pivotability of the supporting body relative to the cover elements, and the supporting bodies are mounted to be merely longitudinally shiftable.

Figure 10:
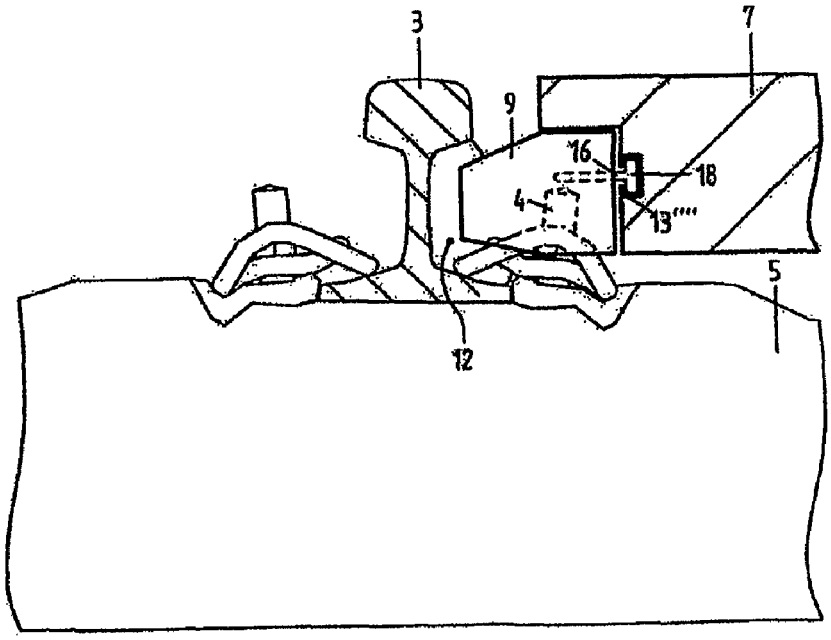

The exemplary embodiment illustrated in FIG. 10 is to be considered as a variant of the exemplary embodiment according to FIGS. 1 and 2, wherein, in the example according to FIG. 10 just as in the example according to FIG. 9, the mounting of the supporting bodies 9 on the cover elements 7, 8 is merely a shiftable one, yet not a pivotable one. On each one of the supporting bodies 9, a carrying ledge 16 is arranged which has a T-cross-section, with the transverse beam 18 of the T-cross-section each being longitudinally shiftably guided in a slit channel 13"" which has a rectangular cross-section matching the dimensions of the transverse beam 18.

Figure 11:
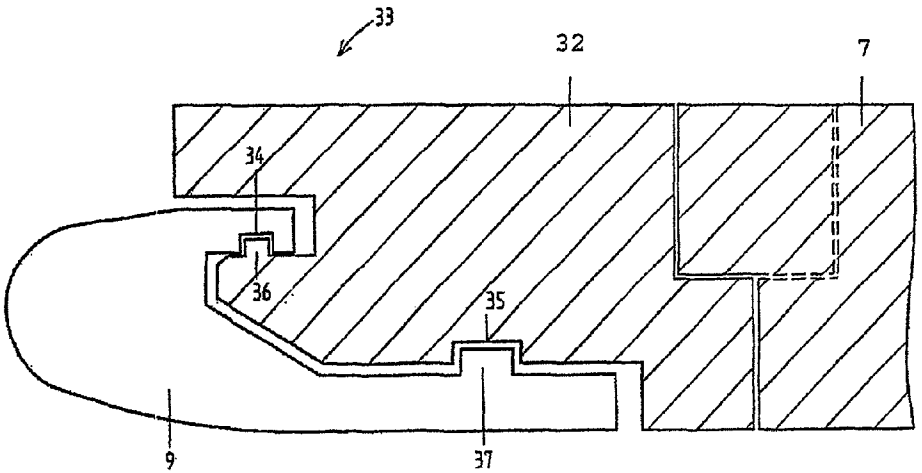
FIG. 11 shows an exemplary embodiment in which the supporting bodies are shiftably mounted on tiltable bodies which in turn are pivotably arranged on the cover elements.

In a sectional illustration analogous to FIG. 2, FIG. 11 shows an exemplary embodiment, in which a mounting of supporting bodies 9 on cover elements 7 (and/or 8) shiftable in rail-longitudinal direction and additionally pivotable is realized in that the supporting bodies 9 are shiftably mounted on tiltable bodies 32 which in turn are pivotably mounted on the cover elements 7 (and/or 8). The tiltable bodies 32 are hinge-like connected to the cover elements 7 (and/or 8), which hinge connections may be formed by a hinge axis inserted between the tiltable bodies and the cover elements or, as indicated in FIG. 11, in the form of inter-engaging fingers which mutually rest on each other which allow for a limited pivoting of the tilting bodies relative to the cover elements. This pivotability is indicated in FIG. 11 by an arrow 33. For a shiftable mounting of the supporting bodies 9 on the tiltable bodies 32, grooves 34, 35 are shaped in these tiltable bodies 32, on the one hand, and in the supporting bodies 9, on the other hand, and ledges 36, 37 engaging in these grooves are moulded to these tiltable bodies and supporting bodies.

Figure 12:
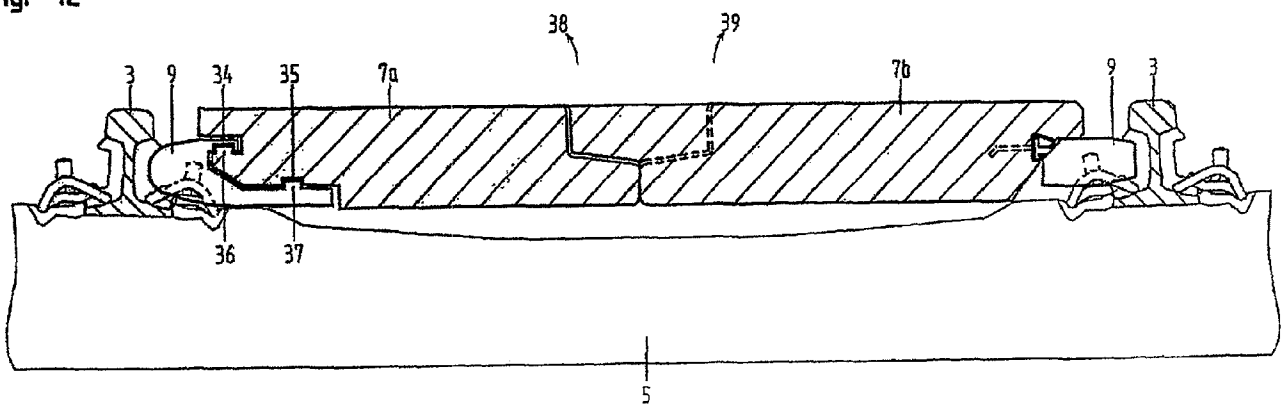
FIG. 12 shows an exemplary embodiment in which the supporting bodies are mounted on the cover elements, wherein the cover elements in turn are designed in form of pairs of slabs and the two slabs of each pair are assembled in hinge-like manner.

A mode of mounting the supporting bodies to be shiftable in the rail-longitudinal direction as provided in the exemplary embodiment according to FIG. 11 may also be directly provided at the cover elements, this being the case in the exemplary embodiment according to FIG. 12. As in the previously described exemplary embodiments, the cover elements may be designed in one piece or, as shown in FIG. 12, in the form of pairs of slabs, wherein the slabs 7*a*, 7*b* of the respective pair are assembled in hinge-type manner. The hinge-type assembly which is realized in a geometric longitudinal axis in parallel with the rail-longitudinal direction enables an upward pivoting of the two slabs 7*a*, 7*b* of the pair of slabs, as indicated by arrows 38, 39. During such a pivoting of the two slabs 7*a*, 7*b* which together form one cover element, also the supporting bodies 9 arranged at the rail side of the two slabs 7*a*, 7*b* are pivoted, such pivoting facilitating the insertion of the cover element in the track and also the removal of such a cover element from the track. As shown in FIG. 12, the hinge-like assembly of the two slabs 7*a*, 7*b*, may be formed by means of two assemblages of inter-engaging fingers which are provided on the mutually facing sides of the slabs 7*a*, 7*b* and mutually rest on each other, or by means of a simple hinge joint with an inserted joint rod. Thus, also with this embodiment it is possible to provide single-part cover elements instead of the cover elements formed in pairs.

The supporting body 9 arranged on the left side of the cover element formed by the two slabs 7*a*, 7*b* of the exemplary embodiment according to FIG. 12 is mounted on the cover element so as to be shiftable only in the rail-longitudinal direction, in analogy to the supporting body 9 provided in the exemplary embodiment according to FIG. 11, wherein, for the shiftable mounting of this supporting body on the cover element, on the one hand, and on the supporting body, on the other hand, grooves 34, 35 are shaped therein, and ledges 36, 37, engaging in these grooves are moulded thereto. On the right side in FIG. 12, a supporting body 9 is arranged on the cover element, which supporting body 9 is designed in analogy to the supporting bodies provided in the exemplary embodiments according to FIGS. 1-3 and is shiftably and pivotably mounted on the cover element. As a variation thereof, it is, however, also possible in the exemplary embodiment according to FIG. 12 to provide, on both sides of the cover elements, supporting bodies which are merely longitudinally shiftable, such as the supporting body illustrated on the left side, or to provide, on both sides of the cover elements, supporting bodies that are designed and mounted like the supporting body shown on the right side in FIG. 12.

A slit channel as is provided in a number of exemplary embodiments of the present invention for the mounting of the supporting bodies arranged on the cover elements of the track cover can be shaped therein during the construction of the components in which such a slit channel is to be provided. For forming such a slit channel, it will in many instances—and also in dependence on the material constituting the components in which a slit channel is to be provided—be advantageous to arrange, or embed, respectively, a slit pipe whose cross-section corresponds to the desired channel cross-section in the respective components. As has already been mentioned above, such a design is also considered preferable in the course of realizing the present invention. Such a slit pipe 40 has been entered in the drawing of FIGS. 2, 6, 7 and 9, e.g., and may also be provided in the other exemplary embodiments, if desired.

Figure 13:
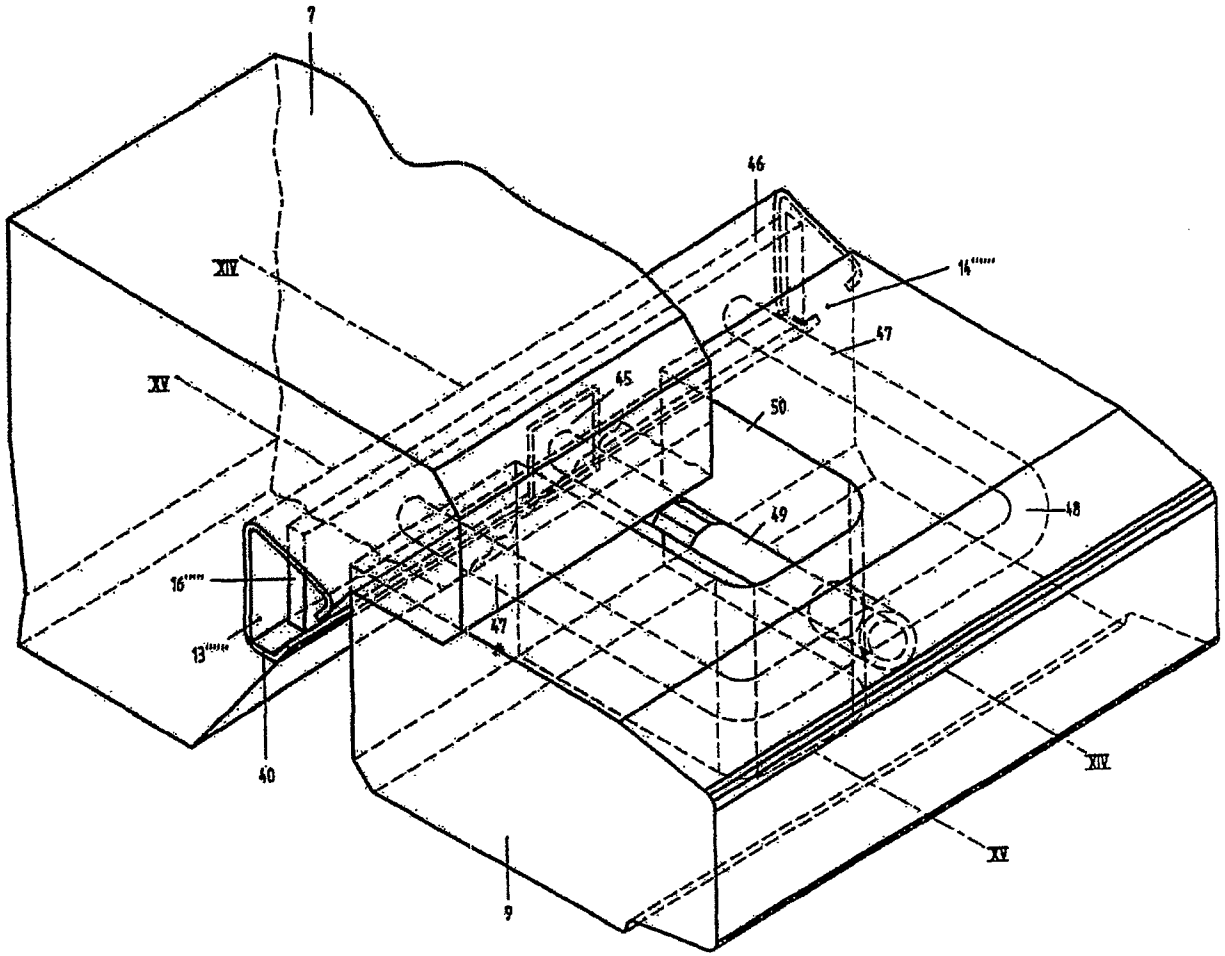
FIG. 13 shows a perspective view of the region of a supporting body in a further exemplary embodiment, in which this supporting body is provided with a fixing means to be tightly held in the position in which it is respectively provided on the cover element.
Figure 14:
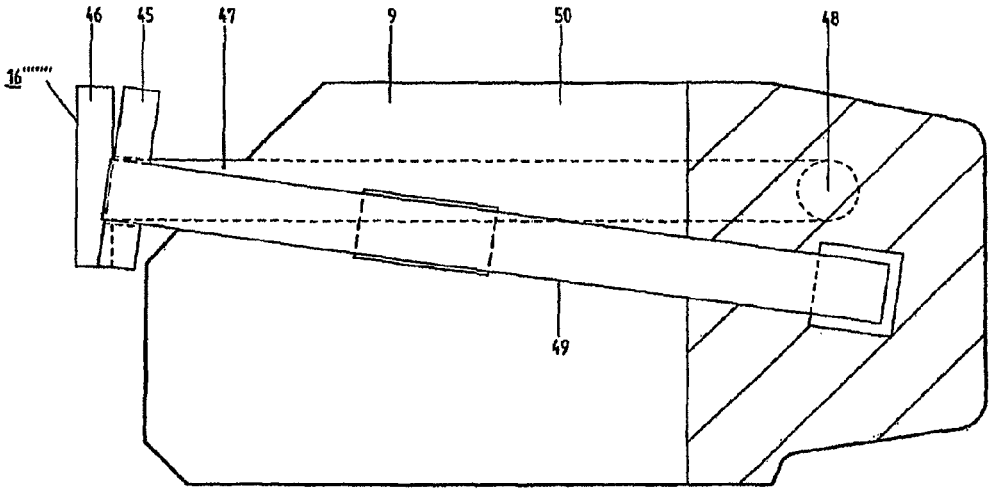
FIG. 14 shows this region in a section according to line XIV-XIV of FIG. 13.
Figure 15:
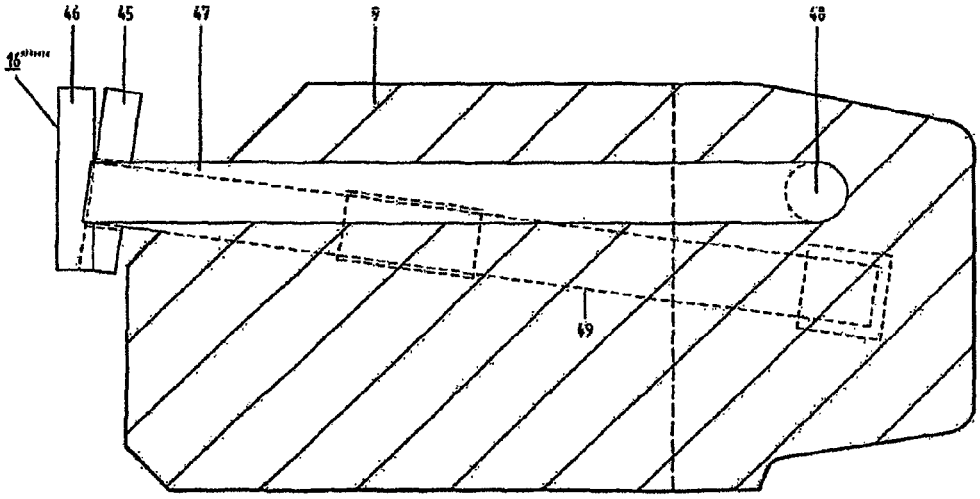
FIG. 15 shows this region in a section according to line XV-XV of FIG. 13.

FIGS. 13, 14 and 15 show a partial region of a track cover according to the invention which comprises fixing means by which the shiftably mounted supporting bodies can be fixed in the respectively provided position. FIG. 13 shows a part of a cover element 7 on which a supporting body 9 is shiftably mounted. In the cover element 7, a slit channel 13""" is provided which is formed by a slit pipe 40 embedded in the cover element at the side where the cover element faces the supporting body 9. The supporting body 9 is provided with a carrying ledge 16""" which engages in the channel 13""" and is shiftable therein. The carrying ledge 16""" is formed by a holding ledge 46 as well as by webs 47 and an anchoring bow 48, the holding ledge 46 being located in the channel 13""", and the webs 47, which extend transversely to the longitudinal extension of this holding ledge and which are connected to the holding ledge, pass through the slit 14""" to the supporting body 9 and within this supporting body adjoin the anchoring bow 48. To fix the holding ledge 46 which is shiftable within the channel 13""" at a certain location, a clamping body 45 is inserted in the channel 13""" beside the holding ledge, which clamping body can be pressed at the channel surface. In the example illustrated, a screw rod 49 is provided for this purpose which engages in a thread provided in the clamping body 45 and has one end resting against the holding ledge 46. At its other end, this screw rod is mounted within the supporting body 9 and, over part of its longitudinal extension, it extends freely within a recess 50 provided in the supporting body 9. There, the screw rod can be turned by hand or by means of a suitable tool for pressing the clamping body 45 on or releasing it. Instead of such a screw rod or other screw, also other components, e.g. wedges, may be provided for pressing a clamping body on.

Figure 16:
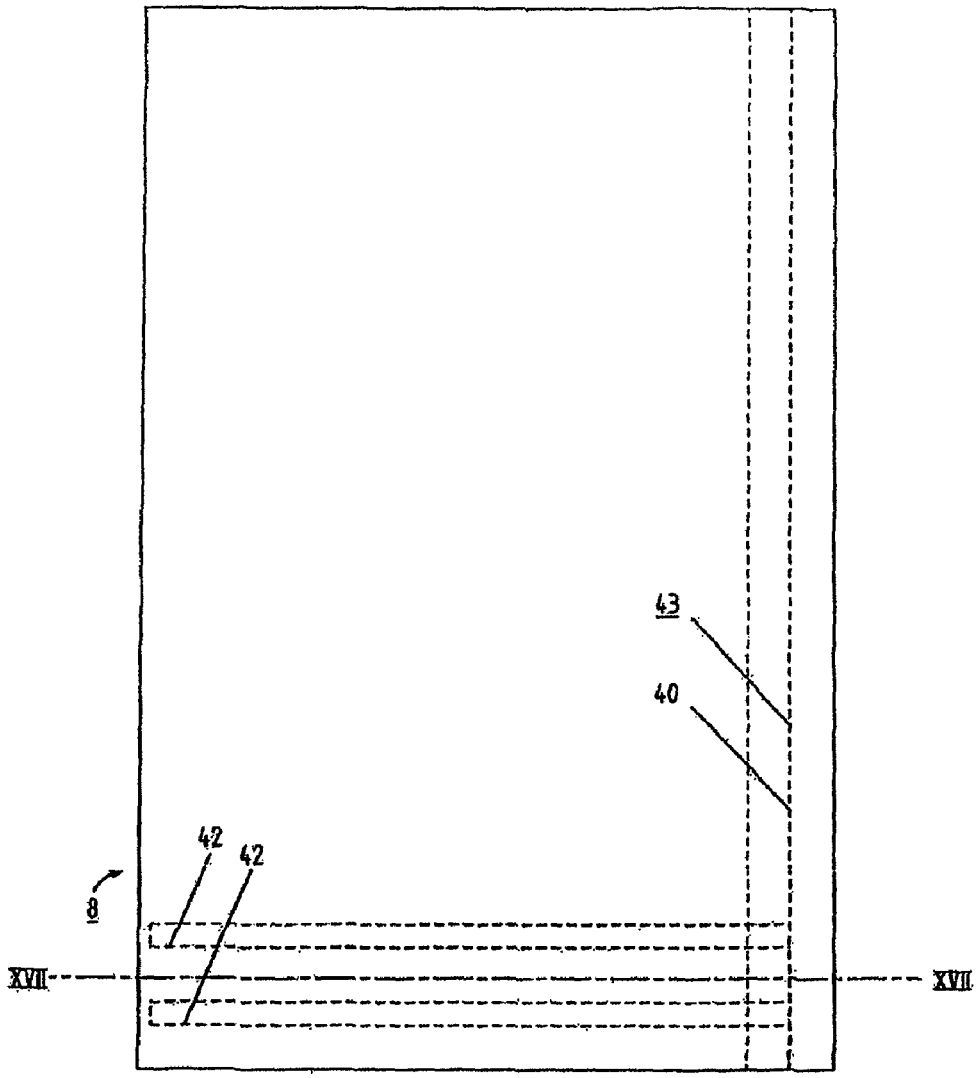
FIG. 16 shows a top view of an example of a cover element.
Figure 17:
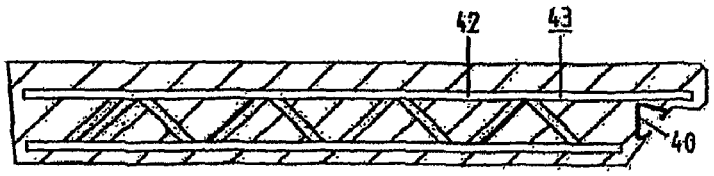
FIG. 17 shows a section of the same according to line XVII-XVII of FIG. 16.

If desired and as a function of the material, also reinforcing bodies may be provided in the cover elements and in the supporting bodies, as has been described before by way of the exemplary embodiments according to FIGS. 6, 7 and 9. Embedding reinforcement means 31 in the supporting bodies and reinforcement means 41 in the cover elements 7, 8 is also indicated in FIG. 2. When slit pipes are present in the cover elements, such slit pipes 40 may also form reinforcing bodies in combination with other components. FIG. 16 shows a top view and FIG. 17 shows a section according to line XVII-XVII of FIG. 16 of a cover element 8 provided for a track cover designed according to the invention, in which cover element 8 a slit pipe 40 is provided for the shiftable mounting of supporting bodies, and this slit pipe 40 is connected to several consecutive, spaced-apart rods 42, and the pipe 40 together with the rods 42 forms a reinforcement body 43 arranged in the cover element 8. To simplify matters and for the sake of a better overview, only a few rods 42 of the reinforcing body 43 are indicated in FIG. 16.

Figure 18:
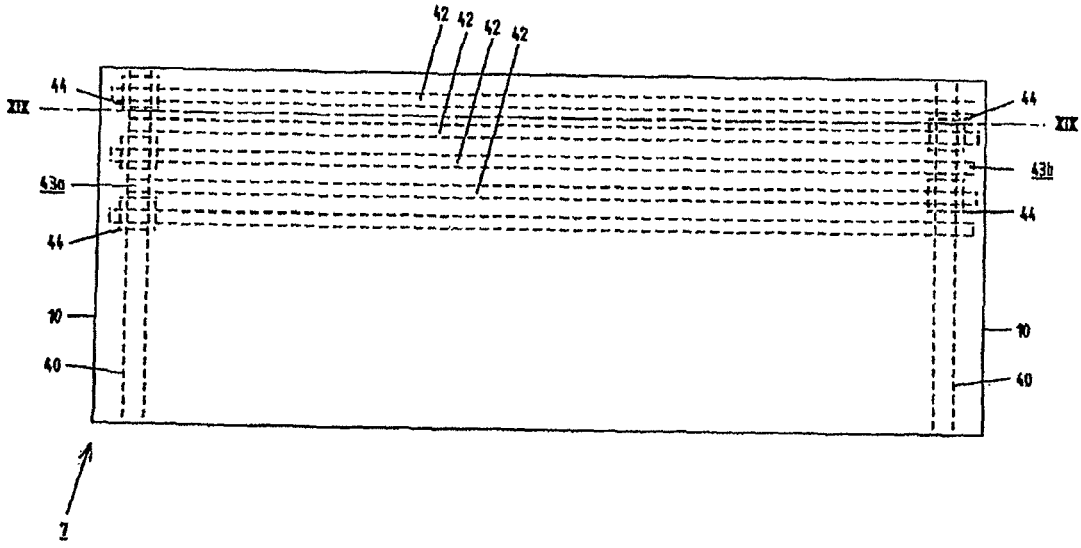
FIG. 18 shows a top view of a further example of a cover element.
Figure 19:
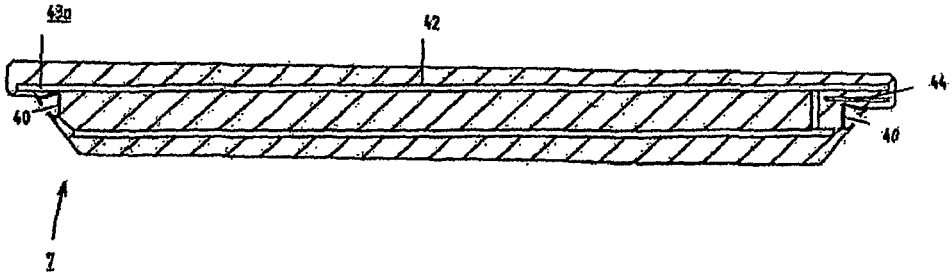
FIG. 19 shows a section of the same according to line XIX-XIX of FIG. 18.

FIGS. 18 and 19 show a top view and a section of a cover element 7 in which two reinforcing bodies 43*a*, 43*b* are embedded, each formed of a slit pipe 40 and rods 42 which extend transversely to the pipe and which are connected to the pipe 40, the slit pipes 40 being arranged on those rims 10 of the cover element 7 which extend in parallel with the rails when the cover element is in its track-inserted state. The rods of the one reinforcing body 43*a* are located in the spaces between the rods of the other reinforcing body 43*b*. These rods of the one reinforcing body 43*a* extend as far as to the slit pipe of the other reinforcing body 43*b*, and likewise, the rods of the other reinforcing body 43*b* extend as far as to the slit pipe of the first-mentioned reinforcing body 43*a*. If the rods 42 and the slit pipes 40 are made of metal, it may be suitable to electrically insulate the slit pipes 40 of the two reinforcing bodies at the contacting sites with the rods of the respective other reinforcing body relative to these rods, and for this purpose, in the exemplary embodiment illustrated in FIGS. 18 and 19, electrically insulating inserts 44 are provided at said sites of contact. This will counteract the formation of electric short circuit windings that might, e.g., have a negative effect on electric signal means, in particular on devices reporting a track being clear. To simplify matters and for the sake of a better overview, only a few rods 42 of these reinforcing bodies 43*a* and 43*b* as well as a few of the inserts 44 are indicated in FIG. 18.

Figure 20:
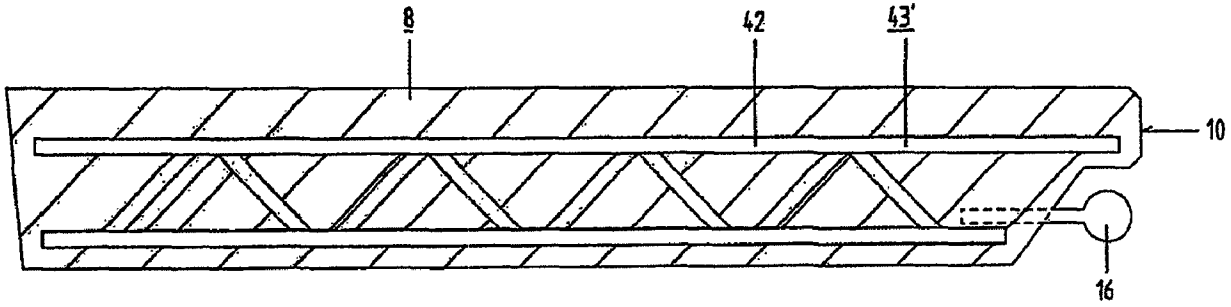
FIG. 20 shows a section of a cover element which is a variant of the embodiment according to FIG. 17.

FIG. 20 shows a cover element 8 which has a carrying ledge 16 at its rim 10 that is to be provided with a supporting body, the carrying ledge being provided to engage in a channel provided in the respective supporting body. In analogy to the illustration of FIG. 16 in connection with a slit pipe, the carrying ledge 16 is connected to several spaced-apart consecutive rods 42 that extend transversely to the carrying ledge 16, and these rods 42 in combination with the carrying ledge 16 constitute a reinforcing body 43'.

Figure 21:
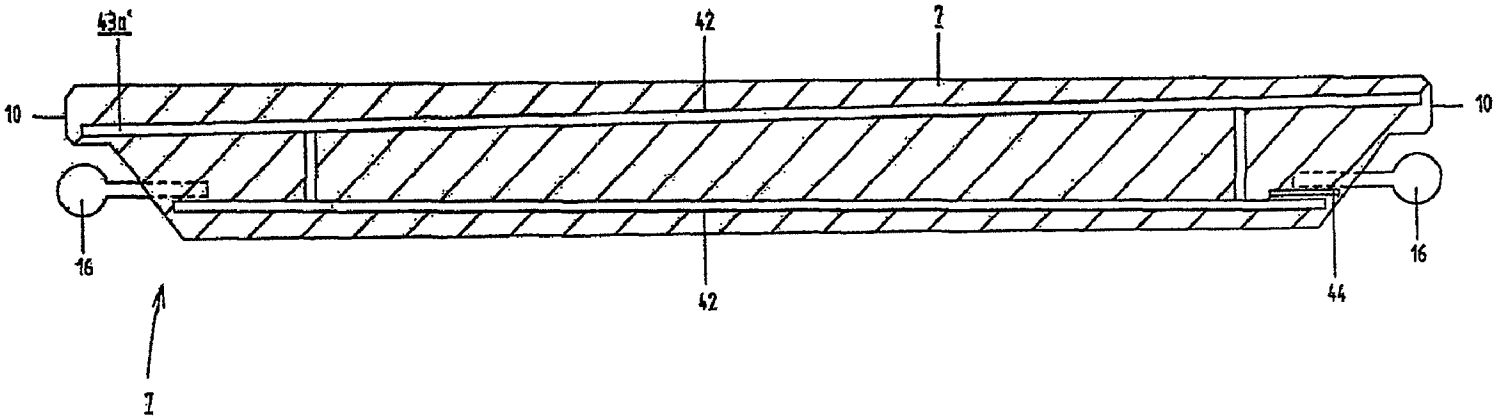
FIG. 21 shows a section of a cover element which is a variant of the embodiment according to FIG. 19.
Figure 22:
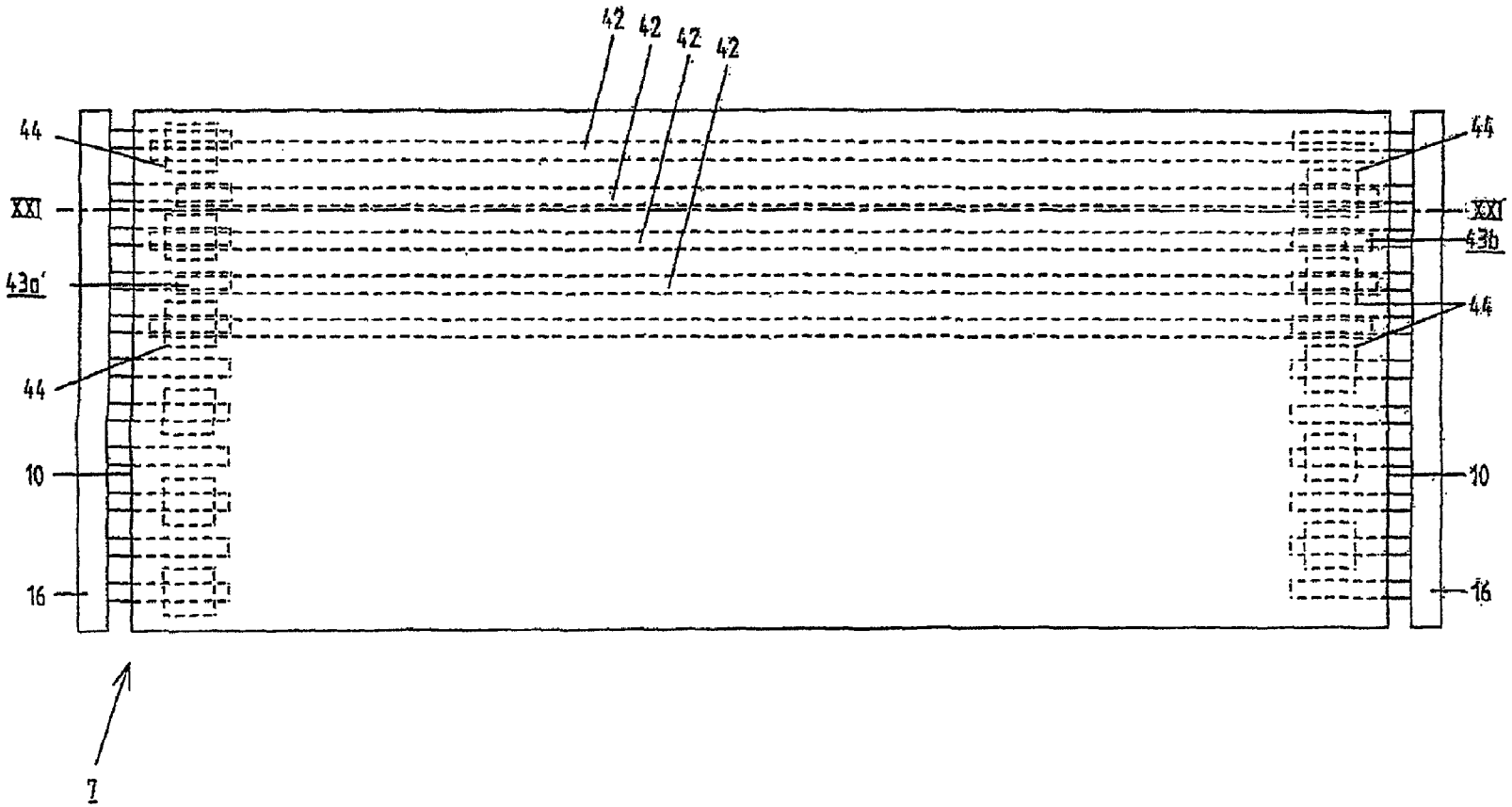
FIG. 22 shows the same in a top view.

FIGS. 21 and 22 show a cover element 7 in which two reinforcing bodies 43*a*', 43*b*' are embedded, each formed of a carrying ledge 16 and of rods 42 extending transversely to this carrying ledge and connected to this carrying ledge. These carrying ledges 16, which are provided for an engagement in slit channels provided in supporting bodies, are arranged on the rims 10 of the cover element. In each of the reinforcing bodies 43*a*', 43*b*', the rods that extend transversely to the carrying ledges are consecutively arranged and mutually spaced apart, and in analogy to the FIG. 18 illustration, the rods of the one reinforcing body are located between the rods of the other reinforcing body. The rods of the one reinforcing body 43*a*' extend as far as to the carrying ledge of the other reinforcing body 43*b*', and likewise, the rods of the other reinforcing body 43*b*' extend as far as to the carrying ledge of the first-mentioned reinforcing body 43*a*'. If the reinforcing bodies are made of metal, it will often be suitable to arrange insulating inserts 44 at the contacting sites of the reinforcing bodies. To simplify, matters and for the sake of a better overview, only a few rods 42 of the reinforcing bodies 43*a*' and 43*b*' are indicated in FIG. 22.

The invention claimed is:

1. A track cover comprising:

slab-shaped cover elements arranged between rails of a track at rail level, said cover elements comprising rims which face the rails, and at the rims of the cover elements, supporting bodies are arranged, the cover elements being supported on the rails by means of the supporting bodies, wherein the supporting bodies (9) which are arranged at the rims of the cover elements (7; 7*a*, 7*b*) that face the rails (3), are mounted to the cover elements so as to be shiftable in a longitudinal direction (11) of the rails (3).

2. The track cover according to claim 1, wherein for each rim (10) of the cover elements (7; 7*a*, 7*b*) that faces the rails (3) of the track (2) provided with the track cover, at least two supporting bodies (9) are mounted shiftably thereto.

3. The track cover according to claim 1, wherein the supporting bodies (9) are mounted so as to be shiftable in the longitudinal direction (11) of the rails (3) and pivotable about a geometric axis which extends in parallel to the longitudinal direction of the rails (3), so that the supporting bodies (9) are downwardly tiltable, starting out from a supporting position in which said cover elements (7; 7*a*, 7*b*) are supported on the rails by means of the supporting bodies.

4. The track cover according to claim 3, wherein the supporting bodies (9) are shiftably mounted to tilting bodies (32) which in turn are pivotably mounted to the cover elements (7).

5. The track cover according to claim 4, wherein for the shiftable mounting of each of the supporting bodies (9) to the respective associated tilting body (32), the tilting bodies and said supporting bodies are provided with shaped-in grooves (34, 35) and moulded-on ledges (36, 37) engaging in the shaped-in grooves.

6. The track cover according to claim 1, wherein for the shiftable mounting of the supporting bodies (9) to the cover elements (7; 7*a*, 7*b*), the cover elements and the supporting bodies are provided with shaped-in grooves (34, 35) and moulded-on ledges (36, 37) engaging in the grooves.

7. The track cover according to claim 1, wherein the cover elements are shaped as pairs of slabs, wherein the pair of slabs (7*a*, 7*b*) are assembled by a hinge having a geometric axis extending in parallel with the longitudinal direction (11) of the rails (3).

8. The track cover according to claim 1, wherein for the shiftable mounting of the supporting bodies (9) on the cover elements (7; 7*a*, 7*b*), at a side of the cover elements which faces the supporting bodies (9), a slit channel (13, 13", 13''', 13'''') having a slit (14, 14", 14''') is provided, said slit (14, 14", 14''') faces the supporting bodies (9), and a carrying ledge (16, 16", 16''') is provided on the supporting bodies, said carrying ledge projecting through said slit into an interior (15) of the slit channel, wherein a width of the carrying ledge has an enlargement (17, 17') at a portion of said carrying ledge which projects in the slit channel wherein a width of the enlargement is larger than a width of the slit.

9. The track cover according to claim 1, wherein for the shiftable mounting of the supporting bodies (9) to the cover elements (7), at a side of the supporting bodies (9) which faces the cover elements a slit channel (13') having a slit is provided, said slit faces the associated cover element (7), and a carrying ledge (16', 16'''') is provided on the associated cover element for projecting through the slit into an interior of the slit channel, wherein the carrying ledge has an enlargement (17') in a portion of the carrying ledge which projects into the slit channel, wherein a width of the enlargement is larger than a width of a slit.

10. The track cover according to claim 8, wherein the carrying ledge (16, 16", 16''''') is pivotably movable in the slit channel (13, 13', 13", 13''''').

11. The track cover according to claim 10, wherein the slit channel (13) has a polygonal cross-section and the carrying ledge (16, 16')projecting into the slit channel has a T-cross-section, wherein a cross-beam (18) of the T-cross-section of the carrying ledge has one edge (19, 19') thereof that faces a corner (20, 20') of the polygonal cross-section, and an other edge (21, 21') that faces a side (22, 22') of the polygonal cross-section located opposite said corner, the carrying ledge (16, 16') thus being pivotably movable about the edge that faces the corner of the polygonal cross-section.

12. The track cover according to claim 10, wherein the slit channel (13", 13''''') has a circular cross-section and the carrying ledge (16", 16''''') projects through the slit (14", 14''''') into the slit channel (13", 13''''') by means of a web having, a cross-sectional shape fittingly abutting an inner surface of the slit channel.

13. The track cover according to claim 11, wherein the carrying ledge (16", 16''') is an integrally co-moulded portion of the respective supporting body (9).

14. The track cover according to claim 13, wherein the supporting bodies (9) are provided with a reinforcement (31) which extends into the portion of the carrying ledge (16", 16''') which is disposed within the slit channel of the respective cover element (7).

15. The track cover according to claim 14, wherein the reinforcement (31) is formed by an assemblage of lamellas having a shape which corresponds to a cross-sectional shape of the supporting bodies (9) with the carrying ledges (16", 16''') at a distance therefrom, the lamellas being mutually spaced apart and consecutively arranged in the longitudinal direction of the supporting bodies (9).

16. The track cover according to claim 9, wherein the carrying ledge (16) is an integrally co-moulded portion of the respective cover element (7).

17. The track cover according to claim 16, wherein the respective cover element (7, 8) is provided with a reinforcement which extends into the portion of the carrying ledge (16) that is disposed within the slit channel of the supporting body.

18. The track cover according to claim 17, wherein the reinforcement is formed by an assemblage of lamellas, having a shape in the region of the carrying ledge, that corresponds to the cross-sectional shape of the carrying ledge at a distance therefrom, the lamellas being mutually spaced apart and consecutively arranged in the longitudinal direction of the carrying ledge.

19. The track cover according to claim 8, wherein the slit channel (13, 13', 13", 13''', 13'''', 13''''', 13''''''), includes a slit pipe (40) embedded therein, having a cross-sectional shape that corresponds to at cross-sectional shape of the slit channel.

20. The track cover according to claim 19, wherein a plurality of slit pipes (40) are arranged in the cover elements (7) and provided for engagement with the carrying ledges that are provided on the supporting bodies (9), each connected to a plurality of rods (42) that extend transversely to the longitudinal direction (11) of the rails in the cover elements (7), wherein the rods, viewed in the longitudinal direction of the rails, are spaced apart and consecutively arranged, so as to form a reinforcing body (43).

21. The track cover according to claim 20, wherein two reinforcing bodies (43*a*, 43*b*) are embedded in the cover elements (7), each reinforcing body being formed of a slit pipe (40) and of rods (42) which extend transversely to said slit pipe and which are connected to the slit pipe, said slit pipes (40) being arranged on the rims (10) of the cover elements which extend in parallel with the rails, and the rods of one of the reinforcing bodies (43*a*) are located in the spaces between the rods of the other one of the reinforcing bodies (43*b*).

22. The track cover according to claim 21, wherein the rods (42) of the one reinforcing body (43*a*) extend to the slit pipe (40) of the other reinforcing body (43*b*) and the rods (42) of the other reinforcing body (43*b*) extend to the slit pipe (40) of the one reinforcing body (43*a*).

23. The track cover according to claim 20, wherein the slit pipes (40) and the rods (42) of the reinforcing bodies (43*a*, 43*b*) are made of metal, and the slit pipes (40) are electrically insulated from the rods of the respective other reinforcing body at the contacting sites with said rods.

24. The track cover according to claim 19, wherein the carrying ledges (16) which are arranged in the cover elements (7) and which are provided for engagement in the slit channels that are arranged in the supporting bodies (9), are each connected to a plurality of rods (42) that extend transversely to the longitudinal direction (11) of the rails in the cover elements (7) and when viewed in the longitudinal direction of the rails, are spaced apart and consecutively arranged, the carrying ledges (16) forming a reinforcing body (43') together with the rods (42).

25. The track cover according to claim 24, wherein two reinforcing bodies (43*a*, 43*b*) are embedded in the cover elements (7), each of the reinforcing bodies being formed of a carrying ledge (16) and rods (42) which extend transversely to said carrying ledge (16) and which are connected to said carrying ledge, said carrying ledges (16) being arranged on the rims (10) of the cover elements (7) which extend in parallel with the rails, and the rods of one of the reinforcing bodies (43*a'*) are located in spaces between the rods of the other one of the reinforcing bodies (43*b'*).

26. The track cover according to claim 25, wherein the rods (42) of the one of the reinforcing bodies (43*a'*) extend to the carrying ledge (16) of the other one of the reinforcing bodies (43*b'*) and, likewise, the rods (42) of the other reinforcing body (43*b'*) extend to the carrying ledge (16) of the one of the reinforcing bodies (43*a'*).

27. The track cover according to claim 26, wherein the carrying ledges (16) and the rods (42) of the reinforcing bodies (43*a'*, 43*b'*) are made of metal, and the carrying ledges (16) are electrically insulated from the rods of the respective other reinforcing body at the contacting sites with said rods.

28. The track cover according to claim 1, further comprising means for fixing the shiftably mounted supporting bodies (9) to the cover elements (7) in the respectively provided position.

29. The track cover according to claim 8, further comprising clamping bodies (45) which are inserted in the respective slit channel (13, 13', 13", 13''', 13'''', 13''''', 13 ''''''), and pressed against the surface of the slit channel for fixing the shiftably mounted supporting bodies (9) in a respectively provided position at the cover elements.

30. The track cover according to claim 29, further comprising a screw (49) for pressing the clamping body (45) against the surface of the slit channel.

31. The track cover according to claim 3, wherein on the lower side (24) of the supporting bodies (9) a flexible guiding lip (23) projecting towards the neighboring rail (3) is provided.

32. The track cover according to claim 1, wherein the track cover comprises slab-shaped first cover elements (7; 7*a*, 7*b*) arranged between the rails (3) of the track on rail level and slab-shaped second cover elements (8) arranged outwardly adjoining the rails (3) of the track, said first and second cover elements (7, 8; 7*a*, 7*b*) comprising rims (10) facing the rails and at said rims (10) of said first and second cover elements supporting bodies (9) are mounted to said first and second cover elements so as to be shiftable in the longitudinal direction of the rails (3).

33. The track cover according to claim 32, wherein at each rim (10) of said first and second cover elements (7, 8; 7*a*, 7*b*) that faces a rail (3) of the track (2) provided with the track cover, at least two supporting bodies are mounted shiftable.

34. The track cover according to claim 32, wherein the supporting bodies (9) are mounted so as to the shiftable in the longitudinal direction (11) of the rails (3) and pivotable about a geometric axis which extends in parallel to the longitudinal direction (11) of the rails (3), so that the supporting bodies (9) are downwardly tiltable starting out from a supporting position in which said first and second cover elements (7, 8; 7*a*, 7*b*) are supported on the rails by means of the supporting bodies.

* * * * *